US006311612B1

(12) United States Patent
Oen

(10) Patent No.: US 6,311,612 B1
(45) Date of Patent: Nov. 6, 2001

(54) LINK ADJUSTMENT MEMBER

(75) Inventor: Richard J. Oen, Wapakoneta, OH (US)

(73) Assignee: The Minster Machine Company, Minster, OH (US)

( * ) Notice: Subject to any disclaimer, the term of this patent is extended or adjusted under 35 U.S.C. 154(b) by 0 days.

(21) Appl. No.: 09/352,158

(22) Filed: Jul. 12, 1999

(51) Int. Cl.[7] ..... B30B 1/06; B30B 1/26

(52) U.S. Cl. ..... 100/257; 74/44; 74/393; 100/282

(58) Field of Search ..... 100/257, 282; 74/44, 52, 393

(56) References Cited

U.S. PATENT DOCUMENTS

| | | | | |
|---|---|---|---|---|
| 2,687,649 | * | 8/1954 | Seragnoli | 74/44 |
| 2,886,973 | * | 5/1959 | Schunemann | 74/27 |
| 3,242,768 | | 3/1966 | Munschauer, Jr. . | |
| 3,572,137 | * | 3/1971 | Nakano | 74/44 |
| 3,785,282 | | 1/1974 | Kamelander . | |
| 3,834,216 | | 9/1974 | Schiller et al. . | |
| 3,869,927 | * | 3/1975 | Lose et al. | 100/282 |
| 4,165,685 | | 8/1979 | Nakada et al. . | |
| 4,542,674 | | 9/1985 | Omo, Jr. . | |
| 4,697,466 | * | 10/1987 | Sugawara et al. | 74/27 |
| 4,846,014 | * | 7/1989 | Shiga et al. | 100/257 |
| 4,884,433 | | 12/1989 | Kato . | |
| 5,000,021 | | 3/1991 | Nakamura et al. . | |
| 5,105,684 | | 4/1992 | Imanishi . | |
| 5,226,337 | | 7/1993 | Imanishi et al. . | |
| 5,299,443 | | 4/1994 | Nakamura . | |
| 5,782,132 | | 7/1998 | Ishibashi et al. . | |

FOREIGN PATENT DOCUMENTS

| | | | | |
|---|---|---|---|---|
| 62-275599 (A) | | 11/1987 | (JP) . | |
| 1-215499-A | * | 8/1989 | (JP) | 100/282 |
| 1-237098-A | * | 9/1989 | (JP) | 100/282 |
| 1-313200-A | * | 12/1989 | (JP) | 100/282 |

OTHER PUBLICATIONS

Atty. Docket No. M–181, Title: Adjustable Link Motion Press, Filed: Feb. 5, 1999, Ser. No. 09/245,942.

* cited by examiner

*Primary Examiner*—Stephen F. Gerrity
(74) *Attorney, Agent, or Firm*—Randall J. Knuth

(57) ABSTRACT

A mechanical press having a variable drive arrangement. The press includes a link drive which drives a crankshaft. The drive altering mechanism includes adjustment means which changes the position of the link drive, thereby altering the drive mechanism of the mechanical press and the corresponding velocity curve of the press slide.

10 Claims, 8 Drawing Sheets

LINK ADJUSTMENT MEMBER

BACKGROUND OF THE INVENTION

1. Field of the Invention

The present invention relates to mechanical presses and more particularly to adjustment of the press drive and corresponding alteration of the slide displacement vs. gear angle curve without disassembly.

2. Description of the Related Art

Mechanical presses of the type performing stamping and drawing operations employ a conventional construction that includes a frame structure having a crown and a bed portion and which supports a slide in a manner enabling reciprocating movement toward and away from the bed. A press drive assembly including a main gear and a crankshaft is arranged to convert rotary-oscillatory motion into the rectilinear reciprocating motion of the slide. These press machines are widely used for a variety of workpiece operations employing a large selection of die sets, with the press machine varying considerably in size and available tonnage depending on its intended use.

Mechanical presses, such as stamping presses and drawing presses, are provided a main gear which imparts rotational motion to a crankshaft. The crankshaft has an eccentric portion, or an eccentric crank link which translates the rotational motion of the crankshaft into reciprocal mechanical activity that is transmitted to the slide through a connecting arm. One complete rotation of the crankshaft produces one complete reciprocating motion of the slide.

Depending upon the type of drive mechanism utilized, the crankshaft can maintain a constant rotational velocity or an irregular rotational velocity. Irregular rotational velocity of the crankshaft is advantageous in press applications wherein reduction of the slide velocity near the bottom of the stroke (i.e. bottom dead center) is required so that the draw speed of the material is not exceeded. Additionally, slide velocity reduction near the bottom of the stroke reduces die wear, press vibration and noise. Presses which utilize different arrangements to produce irregular rotational velocity of the crankshaft are known in the art.

A standard press arrangement which produces constant rotational velocity of the crankshaft consists of a crankshaft and main gear arrangement wherein the crankshaft and main gear are concentric. Irregular rotational velocity of the crankshaft of a mechanical press can be achieved by differing arrangements of the crankshaft and the main gear wherein the crankshaft and the main gear are eccentric and are connected by a link drive assembly. Arrangements such as a link drive create an irregular rotational velocity which is beneficial in that they can be utilized to reduce the velocity of the slide near bottom dead center so that the draw speed of a particular material is not exceeded. Such arrangements are additionally beneficial in that they reduce die wear, press vibration and noise.

Presses utilizing similarly sized main gears may be more suitable for a particular workpiece depending upon whether a link drive or a slider crank drive arrangement is used. The ability to alter the drive mechanism of a mechanical press from a slider crank drive to differing link drive arrangements is advantageous in that one particular press may be utilized for different operations. The desire to create a flexible use mechanical press has led to modular type units being utilized. These modular unit presses allow for differing drive mechanisms to be inserted so that the press will operate as a pure slider crank drive or alternatively as a link type drive.

Different modular units may be used to create different link drive arrangements and geometries. That is to say, link drive arrangements in which the distance between the center line of the crankshaft and the center line of the main gear is different as well as utilizing links of variable length. The distance between the center line of the main gear and the center line of the crankshaft as well as link lengths will be varied depending upon the modular unit chosen, but will be variable only at steps defined by the particular modular units manufactured and utilized.

The ability to vary the drive of a press in this way makes the press more versatile in its application, however, having to stop the press for a long period of time to make this adjustment is problematic. Press down time is experienced while drive mechanisms are exchanged. Room to store a number of modular units must also be provided. Additionally, the space in which the press resides must provide enough room above the crown so that different drive mechanisms may be removed and inserted. Currently, the purchaser of a press must utilize the drive mechanism with which the press is initially equipped or must utilize a press which offers different modular drive units and experience the problems mentioned above.

SUMMARY OF THE INVENTION

The present invention is directed to improve upon the aforementioned mechanical press drive adjustment mechanisms wherein it is desired to adjust the drive mechanism of a mechanical press without experiencing down time and without requiring an inventory of mechanism parts.

The present invention provides an adjustable drive mechanism for a mechanical press which includes the ability to change the position of the drive gear relative to the crankshaft without disassembly of the press.

The invention, in one form thereof, comprises an adjustable drive mechanism for a press. This adjustable drive mechanism includes a link drive and a crankshaft connected to the link drive. Adjustment means are utilized to change the position of the link drive relative to the crankshaft so that the slide velocity vs. distance off bottom dead center curve of the press is altered. The adjustment means changes the position of the link drive without press disassembly.

The invention, in another form thereof, comprises an adjustable drive mechanism for a press which includes a link drive, a crankshaft and a drive pinion. The drive pinion has a center line which defines the axis of rotation of the drive pinion. Adjustment means changes the position of the link drive without disassembly of the drive mechanism. Changing the position of the link drive alters the slide velocity vs. distance off bottom dead center curve of the press. In this form of the current invention, the adjustment means rotates the link drive about the center line of the drive pinion.

In one form of the current invention, the link drive includes a main gear having a center line, a gear link, a crank link and a crankshaft. A first end of the gear link is pivotally connected at one end of an eccentric portion of the main gear. The second end of the gear link is pivotally connected to a first end of the crank link. The second end of the crank link is pivotally connected to the crankshaft.

The invention, in another form thereof, comprises an adjustable drive mechanism for a press. In this form, the adjustable drive mechanism includes a link drive, a crankshaft, a drive pinion and adjustment means. The drive pinion has a center line which defines its axis of rotation. The adjustment means rotates the link drive about the center line of the drive pinion. The adjustment means can be, for example, a partial gear and rotation means for rotating the partial gear about the drive pinion center line. The partial gear has the same axis of rotation as the drive pinion and rotatably supports the main gear. The rotation means can be, for example, a partial gear drive pinion, a hydraulic adjustment means, or a screw adjustment means. If a partial gear drive pinion is utilized as the rotation means, the partial gear drive pinion will selectively rotate the partial gear about the drive pinion center line. Hydraulic adjustment means and/or screw adjustment means (if employed) will have a first end operably connected to the press and a second end operably affixed to an eccentric portion of the partial gear so that actuation of the hydraulic adjustment means and/or screw adjustment means will cause the partial gear to rotate about the drive pinion center line.

Attachment means may be employed for affixing the partial gear to the press when the press is operating. The attachment means can be, for example, an axially moveable clamp.

The invention, in another form thereof, comprises an adjustable drive mechanism for a press which includes a link drive, a crankshaft, a drive pinion and adjustment means. The adjustment means is utilized to change the position of the link drive which consequently alters the slide velocity vs. distance off bottom dead center curve of the press. The adjustment means can be utilized to change the position of the link drive without disassembly of the drive mechanism. A drive pinion is utilized to drive the link drive. The drive pinion has a center line which defines the axis of rotation of the drive pinion. The adjustment means rotates the link drive about the center line of the drive pinion. The link drive includes a main gear which has a center line, a gear link and a crank link. The gear link has a first end which is pivotally connected to an eccentric portion of the main gear. The second end of the gear link is pivotally connected to a first end of the crank link. The second end of the crank link is connected to the crankshaft. In one form of the current invention, the center line of the drive pinion and the center line of the main gear form a substantially horizontal line when the main gear is concentric with the crankshaft.

The invention, in another form thereof, comprises a method of altering the drive mechanism of a mechanical press. In this form, this method comprises the steps of: providing a drive mechanism which includes a drive pinion, a main gear driven by the drive pinion and a crankshaft which is driven by the main gear; and changing the position of the main gear relative to the drive pinion. In one form of the current invention, the step of changing the position of the main gear relative to the drive pinion comprises rotating the main gear about the drive pinion.

The invention, in another form thereof, comprises a method which includes the step of rotating the main gear about the drive pinion. In this form of the current invention, the step of rotating the main gear about the drive pinion comprises the steps of: providing a partial gear, using the partial gear to rotatably support the main gear, and rotating the partial gear about the drive pinion.

The invention, in another form thereof, comprises a method of altering the drive mechanism of a mechanical press which includes the step of rotating the main gear about the drive pinion. In one form of the current invention, the step of rotating the main gear about the drive pinion comprises the steps of: providing a partial gear, using the partial gear to rotatably support the main gear, and rotating the partial gear about the drive pinion. In one form of the current invention, the step of rotating the partial gear about the drive pinion comprises the steps of: providing a partial gear drive pinion, engaging the partial gear drive pinion in driving relationship with the partial gear, and actuating the partial gear drive pinion.

The invention, in another form thereof, comprises a method of altering the drive mechanism of a mechanical press which includes the step of rotating the main gear about the drive pinion. In one form of the current invention, the step of rotating the main gear about the drive pinion comprises the steps of: providing a partial gear, using the partial gear to rotatably support the main gear, and rotating the partial gear about the drive pinion. In one form of the current invention, the step of rotating the partial gear about the drive pinion comprises the steps of: providing a hydraulic adjustment means, connecting the hydraulic adjustment means to the press, connecting the hydraulic adjustment means to the partial gear, and actuating the hydraulic adjustment means to rotate the partial gear.

The invention, in another form thereof, comprises a method of altering the drive mechanism of a mechanical press which includes the step of rotating the main gear about the drive pinion. In one form of the current invention, the step of rotating the main gear about the drive pinion comprises the steps of: providing a partial gear, using the partial gear to rotatably support the main gear, and rotating the partial gear about the drive pinion. In one form of the current invention, the step of rotating the partial gear about the drive pinion comprises the steps of: providing a screw adjustment means, connecting the screw adjustment means to the press, connecting the screw adjustment means to the partial gear, and actuating the screw adjustment means to rotate the partial gear.

The invention, in another form thereof, comprises a press. The press includes a crown and a driveshaft which is rotatably supported by the crown. A drive pinion is mechanically coupled to the driveshaft. The drive pinion has a center line which defines its axis of rotation. A main gear is driven by the drive pinion. A partial gear rotatably supports the main gear. The partial gear is utilized to rotate the main gear about the center line of the drive pinion. When the partial gear is not being utilized to rotate the main gear, it is fixedly supported by the crown and rotatably supports the main gear during press operation. The partial gear is arranged to be rotatably supported by the crown when it is utilized to rotate the main gear. When not rotating the main gear, the partial gear is fixedly supported by the crown. Rotating the main gear alters the slide velocity vs. distance off bottom dead center curve of the press. Attachment means are utilized for affixing the partial gear to the press when the press is operating. The attachment means can be, for example, an axially movable clamp. A partial gear drive pinion selectively rotates the partial gear about the drive pinion center line. In this way, the partial gear drive pinion actuates the partial gear so that the partial gear will rotate the main gear. The main gear is connected through a link arrangement to the crankshaft so that rotation of the main gear alters the drive mechanism of the mechanical press from a slider crank to varying link drive arrangements.

An advantage of the present invention is the ability to create a versatile use press that has a drive mechanism which can be altered from a pure slider crank to a link drive mechanism without disassembly such that press down time is effectively minimized or eliminated.

Another advantage of the present invention is that flexibility of use for a mechanical press can be achieved without having to purchase and store a large number of different modular drive units.

Another advantage of the present invention is that the drive mechanism of the mechanical press is adjustable from a slider crank configuration to multiple link drive configurations.

A further advantage of the present invention is that increased ceiling height is not required above the flexible drive press.

BRIEF DESCRIPTION OF THE DRAWINGS

The above-mentioned and other features and advantages of this invention, and the manner of attaining them, will become more apparent and the invention will be better understood by reference to the following description of an embodiment of the invention taken in conjunction with the accompanying drawings, wherein.

Corresponding reference characters indicate corresponding parts throughout the several views. The exemplification set out herein illustrates one preferred embodiment of the invention, in one form, and such exemplification is not to be construed as limiting the scope of the invention in any manner.

DETAILED DESCRIPTION OF THE INVENTION

Figure 1:
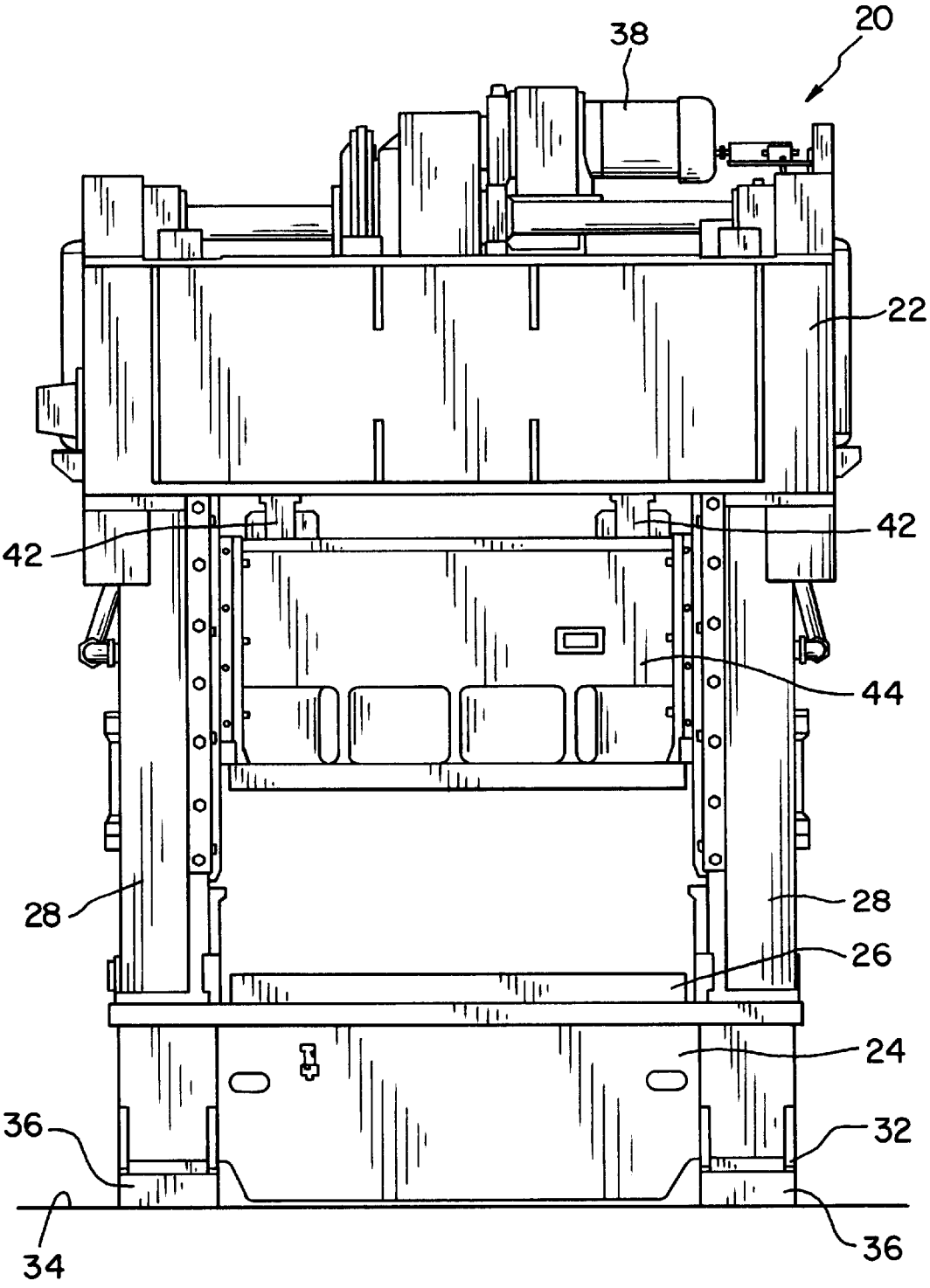
FIG. 1 is a front elevational view of a mechanical press incorporating the link adjustment member of the present invention.

Referring now to the drawings and particularly to FIG. 1, mechanical press 20 comprises a crown 22, a bed 24 having a bolster assembly 26 connected thereto and uprights 28 connecting crown 22 with bed 24. Uprights 28 are connected to the underside of crown 22 and the upper side of bed 24. Tie rods (not shown) extend through crown 22, uprights 28 and bed 24 and are attached on each end with tie rod nuts (not shown). Leg members 32 are formed as an extension of bed 24 and are generally mounted to the shop floor 34 by means of shock absorbing pads 36. A drive mechanism, such as a press drive motor 38 imparts rotational motion to drive pinion 50 (FIG. 2).

Figure 2:
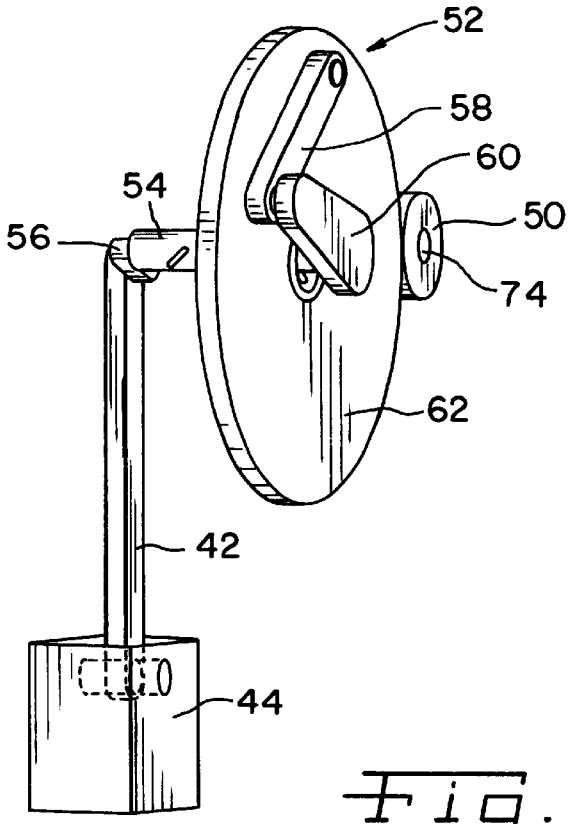
FIG. 2 is a perspective view of one form of the present invention.

Referring now to FIG. 2, link drive 52 is driven by drive pinion 50. Crankshaft 54 is driven by link drive 52. The present invention provides a method and apparatus for adjusting the drive mechanism of a mechanical press. The drive mechanism is adjusted by changing the position of link drive 52 relative to drive pinion 50 and crankshaft 54. Changing the position of link drive 52 will alter the drive of the press from a slider crank drive to varying link drive arrangements.

Link drive 52 includes main gear 62, gear link 58 and crank link 60. Drive pinion 50 imparts rotational motion to main gear 62. Gear link 58 is pivotally connected at one end to an eccentric portion of main gear 62. The opposing end of gear link 58 is pivotally connected to an end of crank link 60. The opposite end of crank link 60 is fixedly connected to crankshaft 54. In this way, rotational energy from drive pinion 50 is imparted to main gear 62 and further to crankshaft 54. Crank link 56 is fixedly connected to crankshaft 54 and is pivotally connected to an end of connecting rod 42. Connecting rod 42 is then connected to slide 44.

Figure 3:
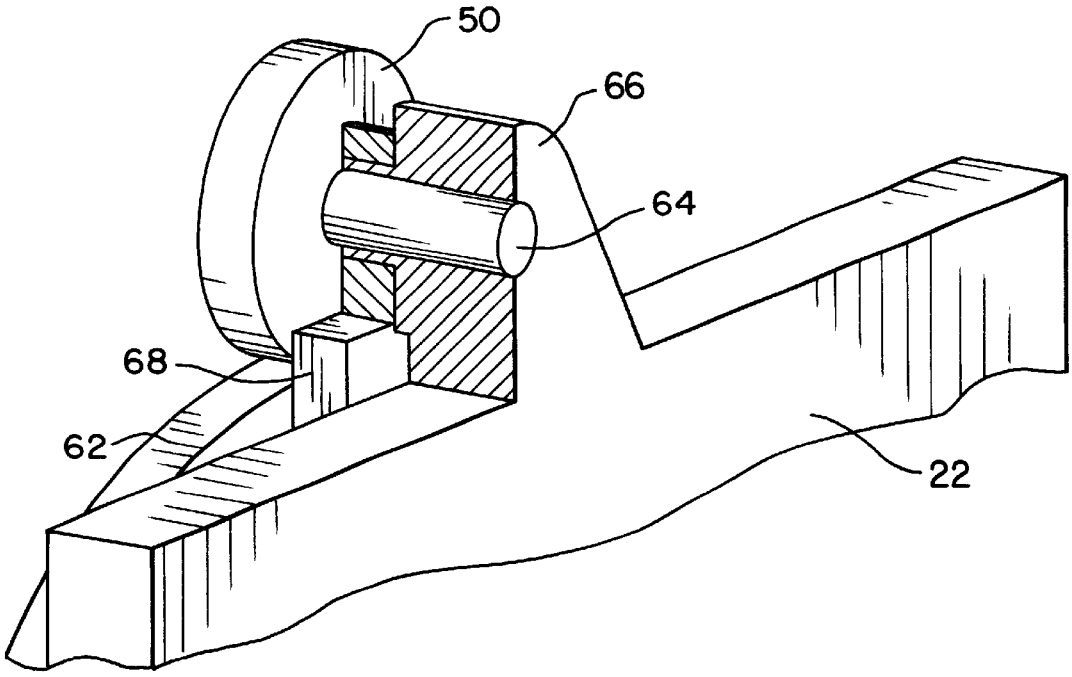
FIG. 3 is a perspective view of one form of the present invention.

As illustrated in FIG. 3, drive pinion 50 is fixedly attached to driveshaft 64. Crown 22 includes driveshaft 64 and partial gear support 66. Partial gear 68 and driveshaft 64 are rotatably supported by driveshaft and partial gear support 66.

Figure 4:
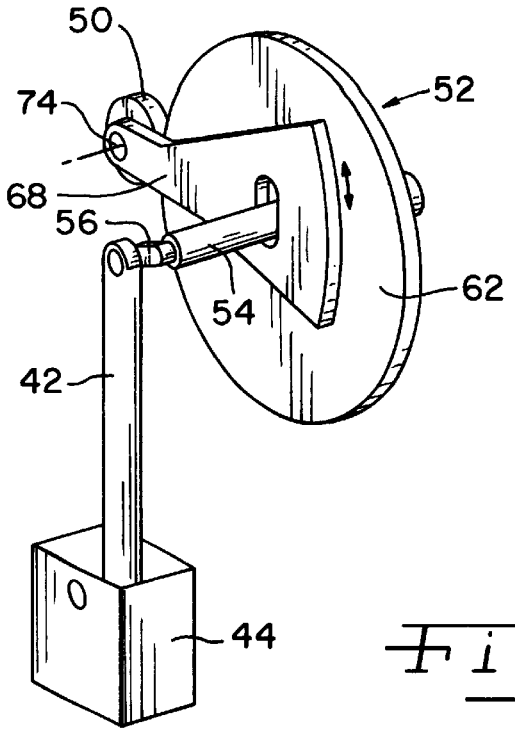
FIG. 4 is a perspective view of one form of the present invention including the adjustment means of the current invention.

As illustrated in FIG. 4, adjustment means, for example, partial gear 68 is utilized to change the position of link drive 52 while maintaining the drive connection between drive pinion 50 and link drive 52. Partial gear 68 has the same axis of rotation as drive pinion 50. Partial gear 68 rotatably supports main gear 62 and selectively rotates main gear 62 about drive pinion center line 74.

Figure 5:
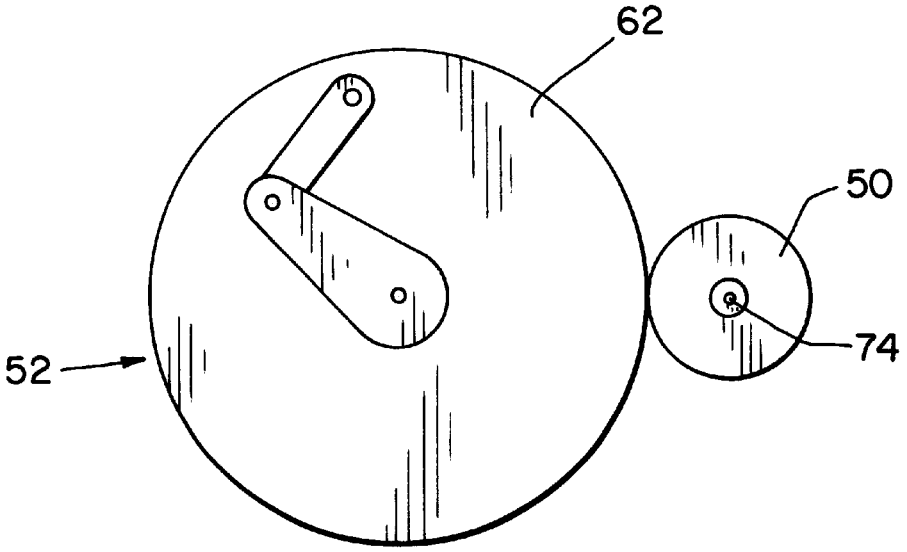
FIG. 5 is an elevational view of the main gear and pinion of the current invention wherein the main gear is concentric with the crankshaft.
Figure 6:
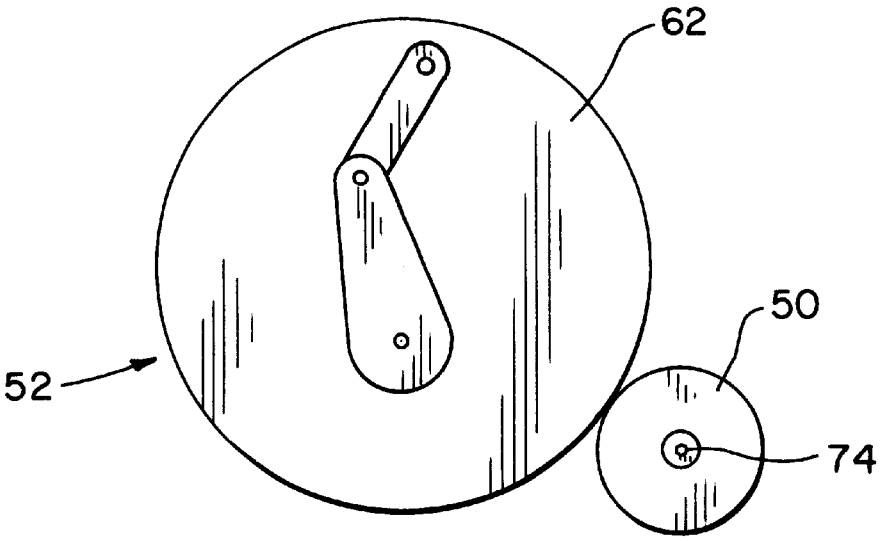
FIG. 6 is an elevational view of one form of the current invention including the main gear and the pinion, wherein the main gear has been adjusted so that it is eccentric with the crankshaft.

FIG. 5 illustrates a configuration of the current invention wherein drive pinion 50 and link drive 52 are arranged to produce a slider crank motion in the mechanical press. In this configuration, the link drive 52 is substantially concentric with crankshaft 54. FIG. 6 illustrates a configuration of the drive mechanism, wherein partial gear 68 has changed the position of link drive 52 to establish a quick return drive for the mechanical press. In this configuration, link drive 52 is eccentric with crankshaft 54.

Partial gear 68 rotatably supports main gear 62 and is operable to effect a change in position of link drive 52. Partial gear 68 is affixed to the frame of mechanical press 20 when it is not being utilized to effect a change in position of link drive 52.

Figure 7:
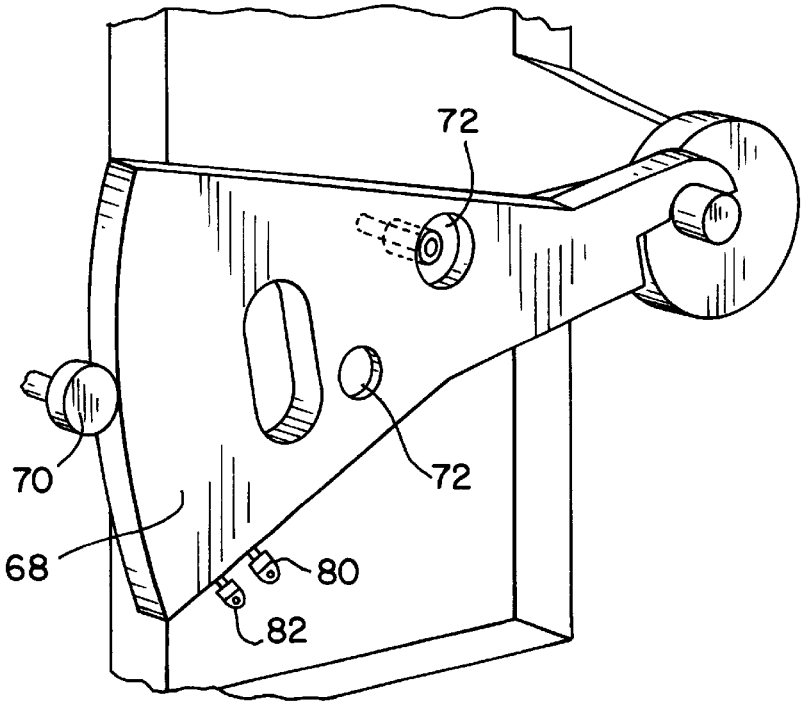
FIG. 7 is a perspective view of one form of the current invention including an axially movable clamp for clamping the partial gear to the crown or frame.

FIG. 7 illustrates partial gear 68 including rotation means for rotating the partial gear. The rotation means can be, for example, partial gear drive pinion 70, screw adjustment means 80, or hydraulic adjustment means 82. Hydraulic adjustment means may be, for example, a hydraulically actuated piston/cylinder arrangement. Partial gear drive pinion 70 will be placed in driving relationship with partial gear 68 to effect rotation of partial gear 68. Screw adjustment means 80 or hydraulic adjustment means 82 may be utilized to rotate partial gear 68. Hydraulic adjustment means 82 and screw adjustment means 80 will be pivotally connected to partial gear 68 and to the press frame. Actuation of these devices will cause partial gear 68 to rotate.

FIG. 7 additionally illustrates an attachment means which will be employed with partial gear 68. Attachment means will be used for affixing partial gear 68 to press 20 when partial gear 68 is not being utilized to alter the position of main gear 62. The attachment means can be, for example, axially movable clamps 72. Axially movable clamps 72 may be axially displaced so that they engage a receiving bore in press 20 or partial gear 68 as necessary. Axially movable clamps 72 may also utilize a high friction material which will engage press 20 as necessary and thereby clamp partial gear 68 to press 20. The above-described clamping mechanisms are illustrative only and are not meant to limit scope of the current invention in any way. Many clamping structures are known and may be utilized to couple partial gear 68 to press 20.

Figure 8:
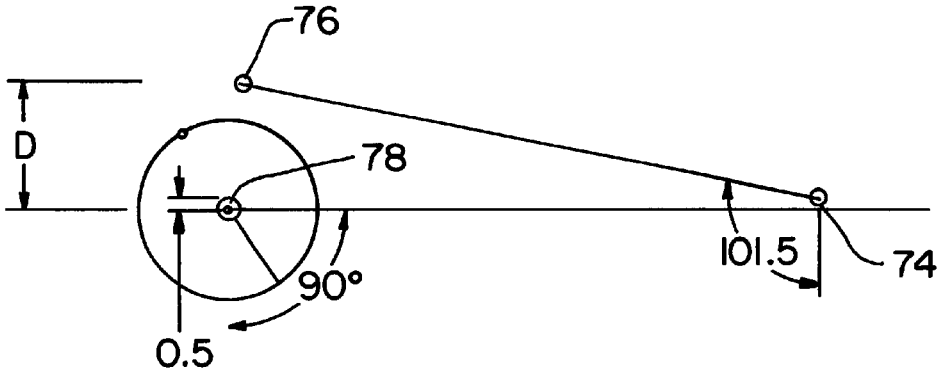
FIG. 8 is a graphical representation of the current invention wherein the drive has been adjusted to produce a quick return slide motion.
Figure 9:
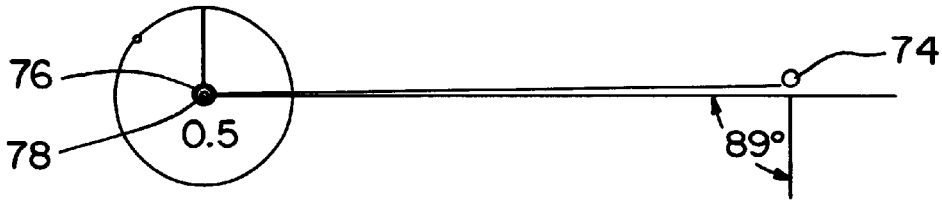
FIG. 9 is a graphical representation of the current invention wherein the drive has been adjusted to produce a slider crank drive configuration.

FIGS. 8 and 9 are graphical representations of different drive configurations of the current invention. FIG. 8 illustrates a quick return drive configuration wherein main gear 62 has gone through a change in position such that it is now eccentric with crankshaft 54. As illustrated in FIG. 8, drive pinion center line 74 and crankshaft center line 78 maintain their position while main gear center line 76 changes position and specifically, is moved a distance D from crankshaft center line 78.

FIG. 9 graphically illustrates a configuration of the drive mechanism of the current invention wherein main gear 62 is maintained in eccentric relation to crankshaft 54. In this configuration, the drive mechanism of the mechanical press operates to produce a slider crank motion.

Figure 10:
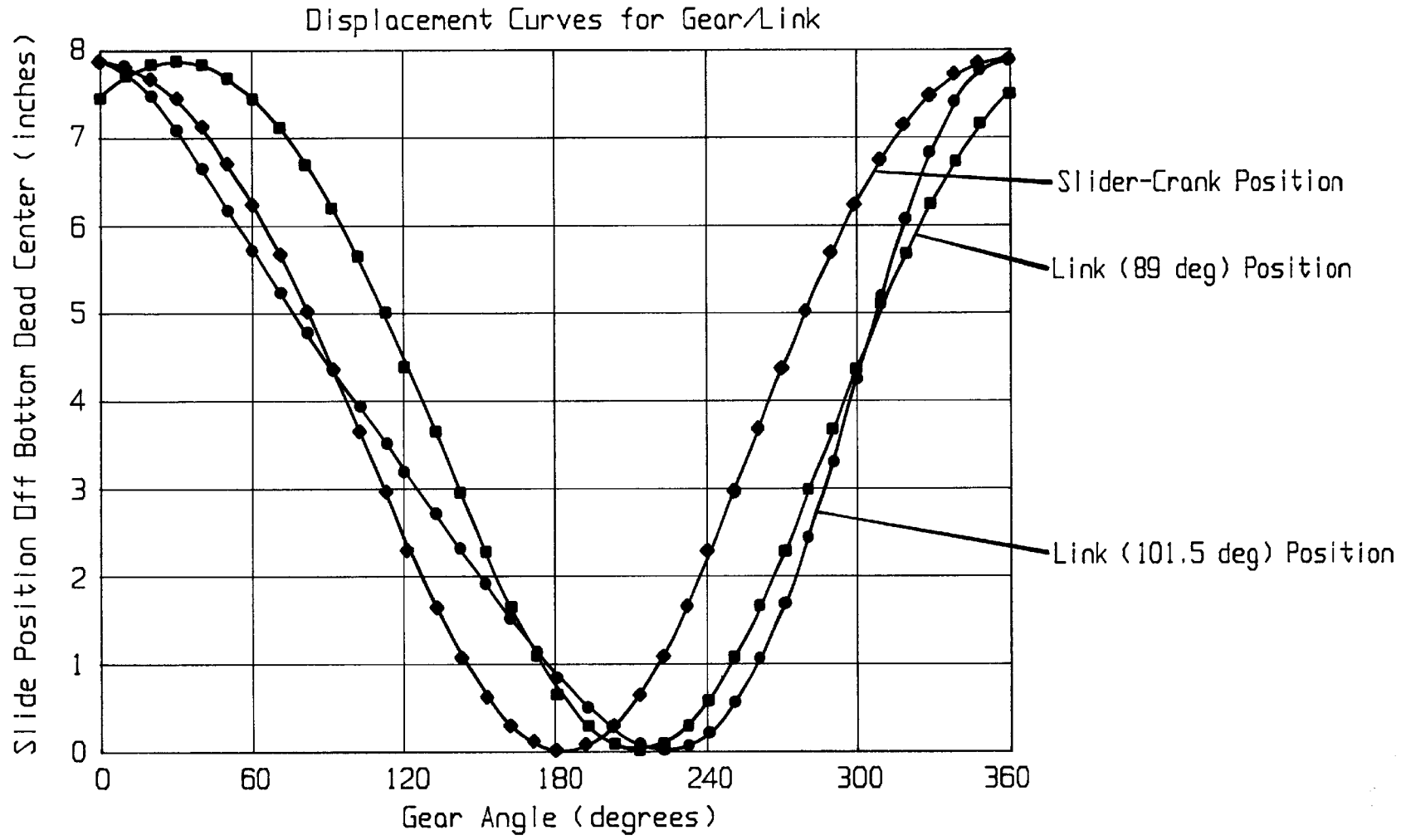
FIG. 10 is a graphical representation of the slide position off bottom dead center vs. the gear angle for various drive arrangements.
Figure 11:
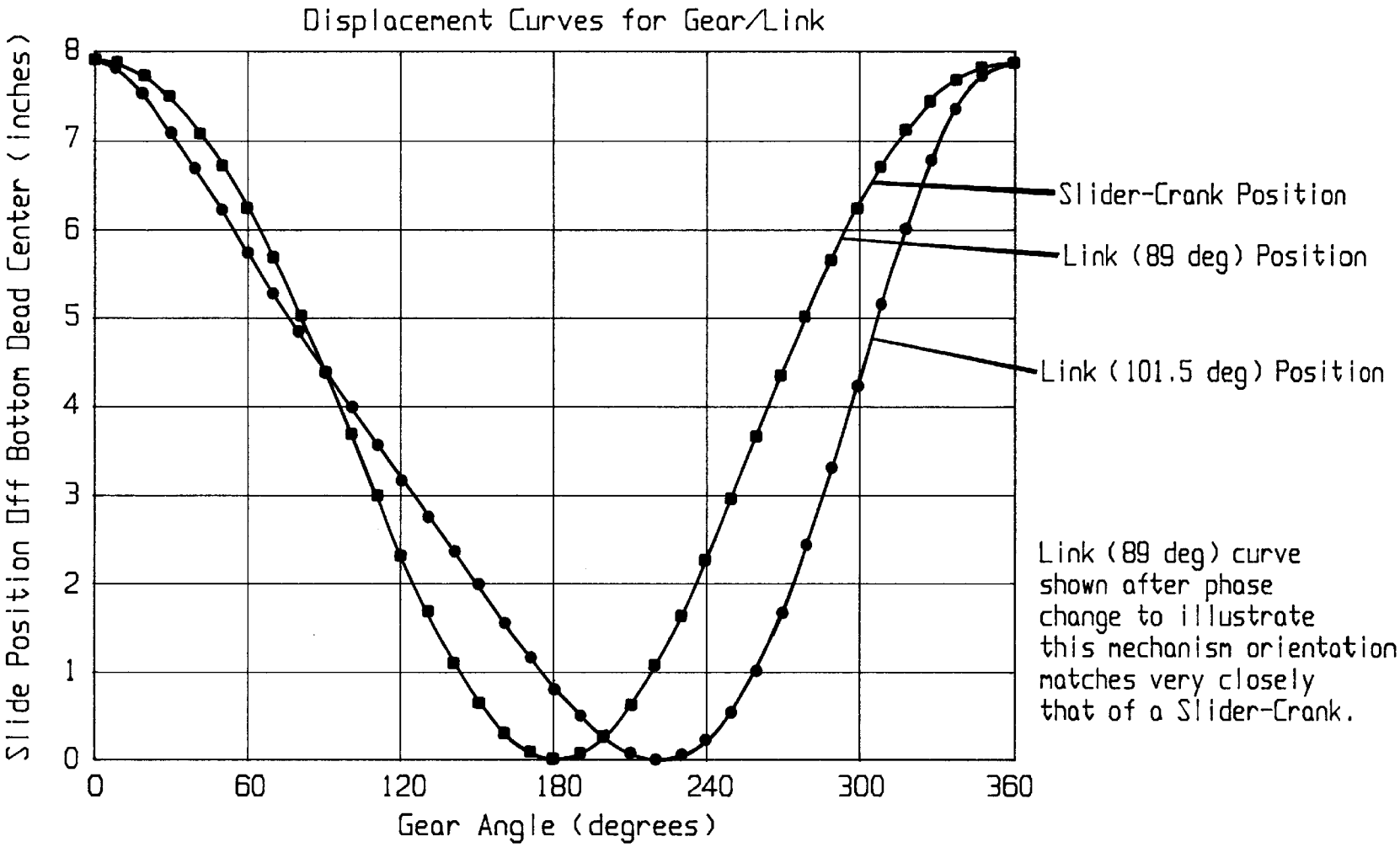
FIG. 11 is a graphical representation of slide position off bottom dead center vs. gear angle which includes a curve representing a slider crank configuration of the current adjustable drive mechanism and a curve representing a link drive arrangement of the current adjustable drive mechanism.

FIGS. 10 and 11 are graphical representations of the slide position off bottom dead center vs. gear angle of a mechanical press. FIG. 10 depicts a slider crank curve as well as a curve corresponding to a particular orientation of the drive mechanism of the current invention which produces a curve which is substantially similar to the slider crank curve. FIG. 10 additionally depicts a substantially dissimilar curve which may be produced by a configuration of the current invention and which corresponds to a quick return drive configuration.

In FIG. 11, the slider crank curve of FIG. 10 and the curve corresponding to the configuration of the drive mechanism as depicted in FIG. 9 of the current invention are superimposed and as illustrated here are substantially similar. FIG. 11 additionally depicts a quick return drive arrangement of the current invention as illustrated in FIG. 8. The adjustment member of the current invention may be utilized to create slide position off bottom dead center vs. gear angle curves which vary between the two curves illustrated in FIG. 11.

Figure 12:
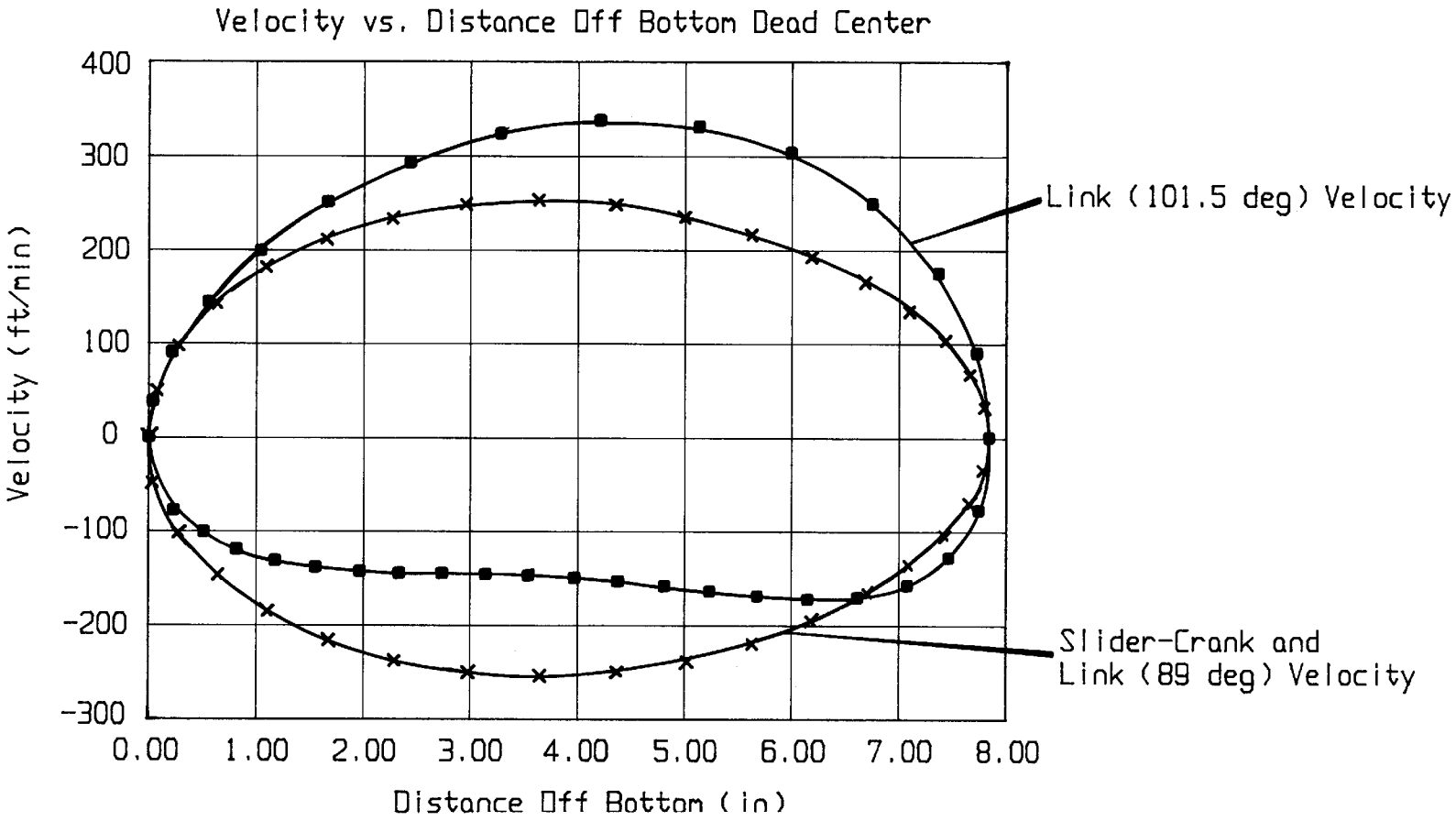
FIG. 12 is a graphical representation of the velocity of the slide with respect to its distance off bottom dead center.

During press operation, a controller, operator or other mechanism may actuate the adjustment means. Actuation of the adjustment means changes the position of link drive 52 and thus alters the distance D between the main gear center line 76 and the crankshaft center line 78. As the distance D between the main gear center line 76 and the crankshaft center line 78 is increased, the drive structure creates a slide motion that consists of slow slide motion as the slide approaches bottom dead center and faster slide motion as the slide approaches top dead center. FIG. 12 depicts such a "quick return" slide velocity curve. The slide velocity vs. distance off bottom dead center curve, as seen in FIG. 12, can be altered such that the velocity vs. distance off bottom dead center curve may be any curve between the slider crank curve and the curve associated with a drive configuration wherein the link drive 52 has experienced the maximum change in position allowed by the adjustment means of this embodiment of the current invention. The range of adjustment exemplified in this description is by example only and is not intended to be limiting in any way.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. An adjustable drive mechanism for a press, said press including a slide, said adjustable drive mechanism comprising:

a link drive;

a crankshaft connected to said link drive; and adjustment means for changing the position of said link drive relative to said crankshaft more than two different arrangements without disassembly of the drive mechanism, whereby changing the relative position of said link drive alters the slide velocity vs. distance off bottom dead center curve of the press.

2. The adjustable drive mechanism as recited in claim 1, further comprising:

a drive pinion having a center line, said center line of said drive pinion defining the axis of rotation of said drive pinion, said adjustment means rotates said link drive about said center line of said drive pinion.

3. The adjustable drive mechanism as recited in claim 2, wherein said link drive comprises:

a main gear having a center line;

a gear link having a first end and a second end, said first end of said gear link pivotally connected to an eccentric portion of said main gear; and a crank link having a first end and a second end, said first end of said crank link pivotally connected to said second end of said gear link, said crankshaft connected to said second end of said crank link.

4. The adjustable drive mechanism as recited in claim 3, wherein said center line of said drive pinion and said center line of said main gear form a substantially horizontal line when said main gear is concentric with said crankshaft.

5. The adjustable drive mechanism as recited in claim 2, wherein said adjustment means comprises:

a partial gear, said partial gear having the same axis of rotation as said drive pinion, said partial gear rotatably supporting a main gear; and rotation means for rotating said partial gear about said drive pinion center line.

6. The adjustable drive mechanism as recited in claim 5, wherein said rotation means comprises:

a partial gear drive pinion, said partial gear drive pinion selectively rotating said partial gear about said drive pinion center line.

7. The adjustable drive mechanism as recited in claim 5, wherein said rotation means comprises:

a hydraulic adjustment means, said hydraulic adjustment means having a first end and a second end, said first end of said hydraulic adjustment means operably connected to the press, said second end of said hydraulic adjustment means operably affixed to an eccentric portion of said partial gear.

8. The adjustable drive mechanism as recited in claim 5, wherein said rotation means comprises:

a screw adjustment means, said screw adjustment means having a first end and a second end, said first end of said screw adjustment means operably connected to the press, said second end of said screw adjustment means operably affixed to an eccentric portion of said partial gear.

9. The adjustable drive mechanism as recited in claim 5, further comprising:

attachment means for affixing said partial gear to the press when the press is operating.

10. The adjustable drive mechanism as recited in claim 9, wherein said attachment means comprises:

an axially movable clamp.

* * * * *